United States Patent [19]

McCracken

[11] Patent Number: 4,964,256

[45] Date of Patent: Oct. 23, 1990

[54] BEAM MEMBER FOR CONCRETE FORMING SYSTEM

[75] Inventor: Robert G. McCracken, Des Moines, Iowa

[73] Assignee: Economy Forms Corporation, Des Moines, Iowa

[21] Appl. No.: 461,352

[22] Filed: Jan. 5, 1990

[51] Int. Cl.[5] ..... E04C 3/30

[52] U.S. Cl. ..... 52/726; 52/729; 29/897.34; 29/897.35

[58] Field of Search ..... 29/150, 155 R; 228/189, 228/182; 72/335, 379; 248/351; 52/723, 726, 729, 301

[56] References Cited

U.S. PATENT DOCUMENTS 2,936,051 5/1960 Martin ..... 52/726

3,094,197 6/1963 Attwood ..... 29/155 R

*Primary Examiner*—P. W. Echols

*Assistant Examiner*—David P. Bryant

*Attorney, Agent, or Firm*—Kent A. Herink

[57] ABSTRACT

A light-weight, high-strength beam member for use in concrete form assemblies. An end plate is secured by weldment to each end of a pair of channel members arranged in a back-to-back, spaced apart relation. The channel members includes a pair of transversely opposite leg sections with inturned terminal edges and an interconnecting web section. The terminal end portion of the web section is foreshortened by one-half the thickness of an end plate. In assembly, an end plate rests against the terminal edge of the web sections and is partially recessed in the leg sections and inturned edges of the channel members. Upon welding of the end plates to the channel members a high-strength end connection is created which permits full strength beam assemblies to be constructed by interconnecting end-to-end a plurality of individual beam members.

9 Claims, 2 Drawing Sheets

BEAM MEMBER FOR CONCRETE FORMING SYSTEM

BACKGROUND OF THE INVENTION

The invention relates generally to concrete forming systems and, more specifically, to light-weight, high-strength beam members useful in a multitude of applications in concrete forming systems and assemblies including the support of an upright form assembly in a predetermined upright position.

Concrete forming systems are well known and widely used in the construction of diverse concrete structures. Certain of these systems make use of beams or soldiers as upright and horizontal structural members, inclined braces, columns, shores, walers, and the like. Known beams are formed of a pair of channel members arranged back-to-back in a spaced relation and having an end plate butt-welded to each of the ends of the pair of channel members. An example of such beams are those of Rapid Metal Developments Limited, Aldridge, England.

An application of the known beams is described by their manufacturers as being the bolting together in an end-to-end relation two or more beam members for assembly into beams of extended length. Such beam assemblies, however, because of butt-welded end plates have severely decreased strengths relative to a single beam member of the same length.

The beam members of the present invention are both light-weight and high-strength and, when bolted end-to-end, form an extended beam assembly that has the same strength as a single beam member of the same length.

SUMMARY OF THE INVENTION

The invention consists of a beam member for use in the support of metal concrete form assemblies. A pair of like channel members are formed from a sheet of metal material with a pair of transversely opposite leg sections having inturned terminal edges or flanges and an interconnecting web section. A rectangular metal end plate for each end of the beam member are provided and are of a thickness greater than that of the metal sheet. The terminal ends of the web sections of the channel members are foreshortened by an amount equal to one-half the thickness of an end plate. The pair of channel members are arranged back-to-back in a parallel spaced relation to provide at either end a plate-receiving area of a size and shape of an end plate. Each end plate is located within each plate-receiving area in contact engagement with the ends of the foreshortened web sections and within the four corners formed by the inturned terminal edges of the leg sections. The end plates are secured by weldments to the channel members. A plurality of beam members may be bolted together in an end-to-end relation to form an extended length beam assembly.

DETAILED DESCRIPTION OF A PREFERRED EMBODIMENT

Figure 2:
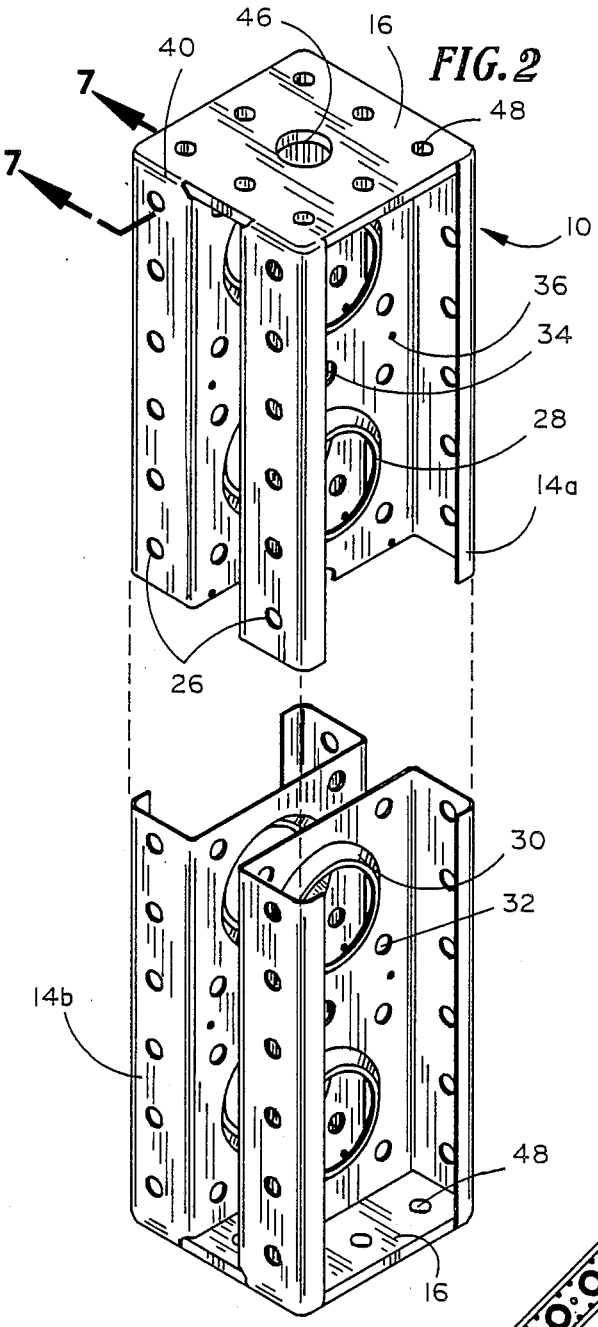
FIG. 2 is a perspective foreshortened view of a beam member.
Figure 1:
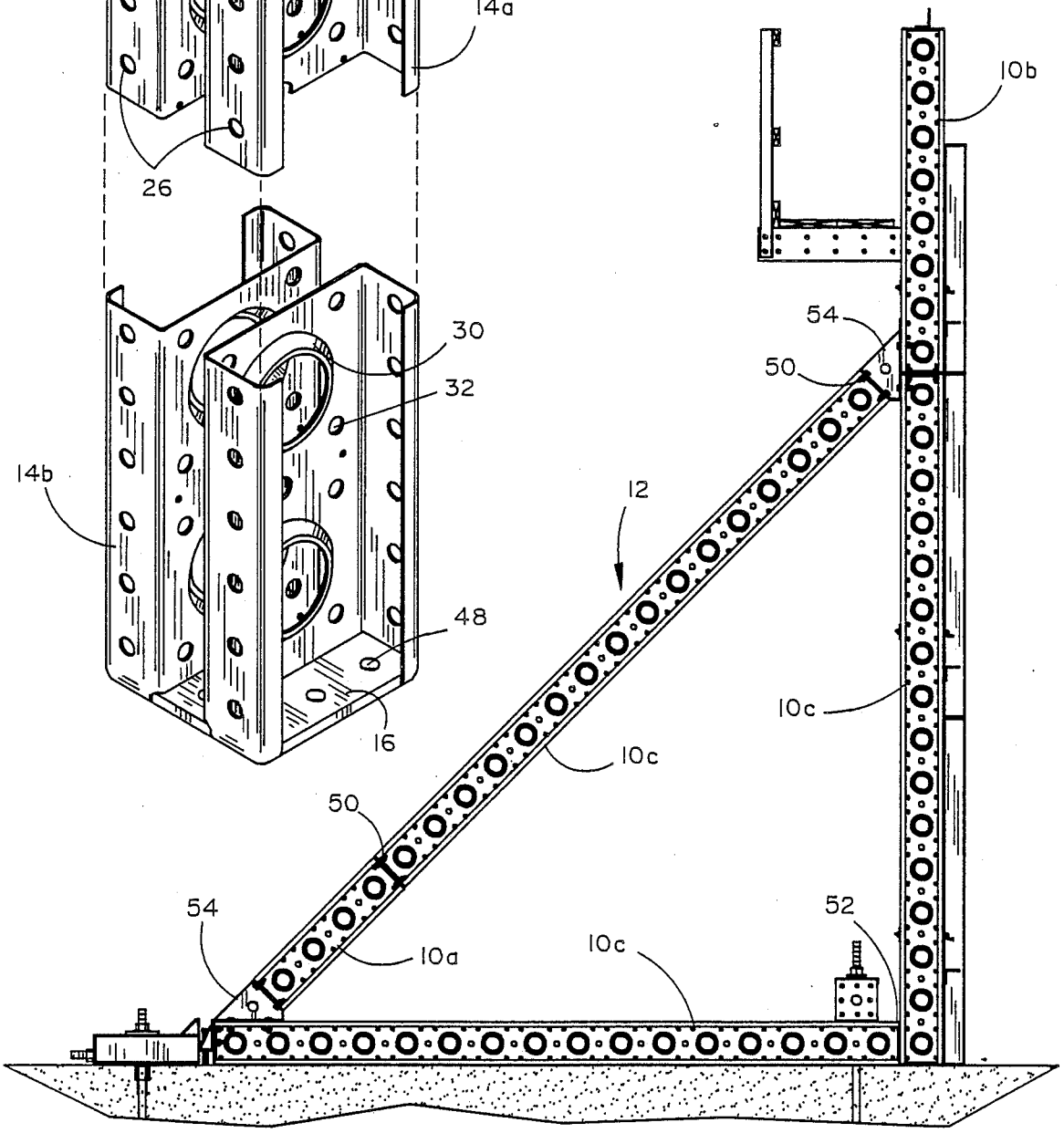
FIG. 1 is an elevational view of a metal concrete form assembly wherein a plurality of interconnected beam members of the present invention constitute a form structure for the form assembly.

Referring first to FIG. 2 there is illustrated, generally at 10, a beam member for use in metal concrete form assemblies such as illustrated in FIG. 1 generally at 12. The beam member 10 of the preferred embodiment is manufactured in three lengths, a three foot length 10*a*, a six foot length 10*b*, and a twelve foot length 10*c*. A beam assembly of any integral multiple of three feet can be assembled by bolting together selected ones of beam members 10*a–c* in an end-to-end relation, as will be described in more detail hereinafter.

Figure 3:
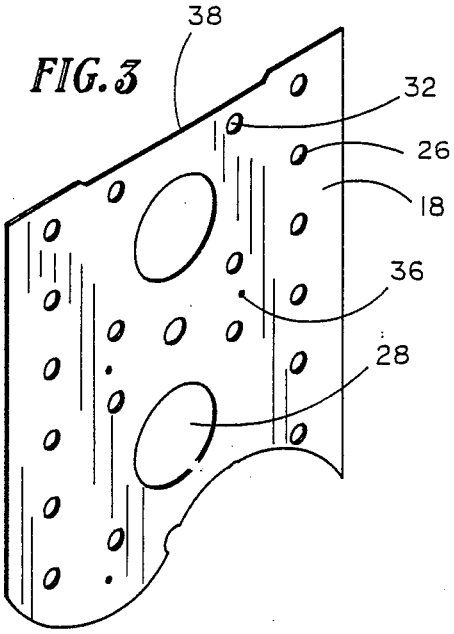
FIG. 3 is a detail perspective view of a metal sheet that has been partially prepared for forming into a channel member.
Figure 4:
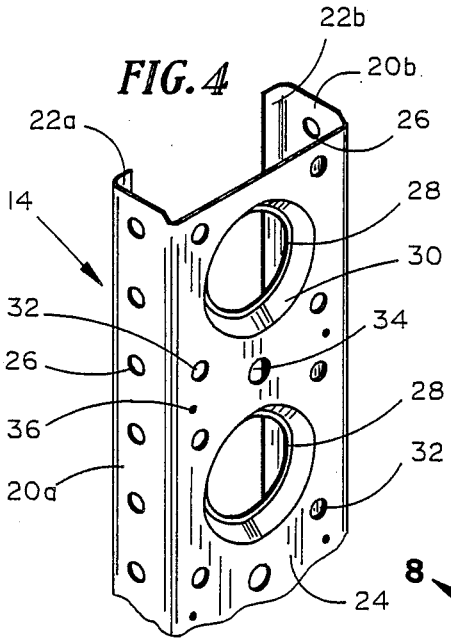
FIG. 4 is a partial perspective view of a formed channel member.

The beam members 10 include a pair of channel members 14*a* and 14*b* that are arranged in a back-to-back, spaced relation, to each end of which is welded a rectangular end plate 16. The channel members 14 are formed of a metal sheet material 18 which is illustrated in FIG. 3 after having been initially perforated with a plurality of openings. The metal sheet 18 is formed into a channel member 14 having a pair of transversely opposite leg sections 20*a* and 20*b* with inturned terminal edges or flanges 22*a* and 22*b* and an interconnecting web section 24 (FIG. 4). Openings 26 for connecting bolts (not shown) are spaced longitudinally along each of the leg sections 20*a* and 20*b*. Spaced along the central longitudinal axis of the web section 24 are openings 28 that have a cupped peripheral edge 30. Four openings 32 are arranged evenly about each of the openings 28. Equidistant between each large opening 28 is a bolt opening 34. Finally, a nailing hole 36 is spaced transversely on either side of each of the bolt openings 34.

Figure 5:
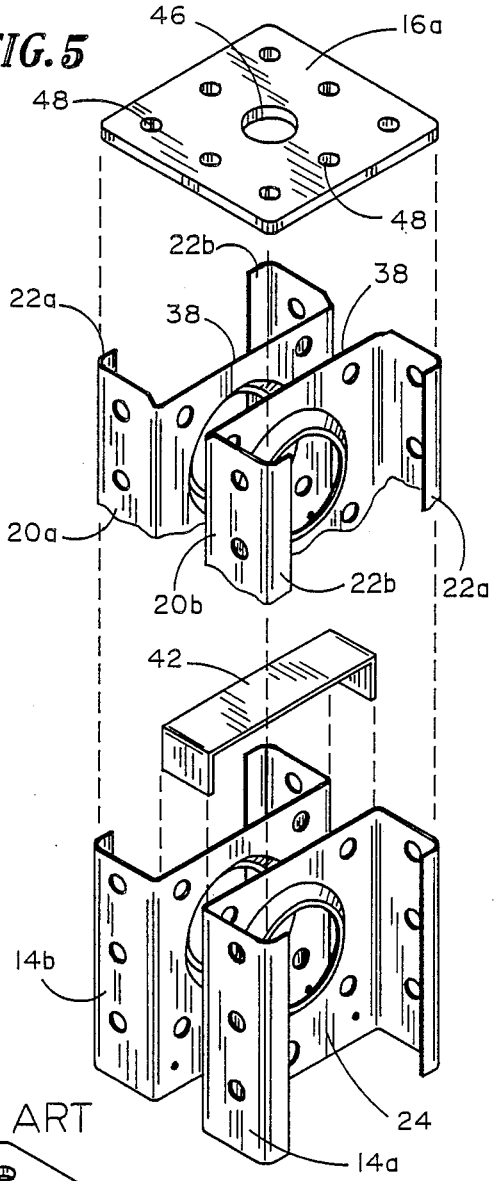
FIG. 5 is an exploded detail perspective view of an end of a beam member showing a pair of channel members arranged in a back-to-back spaced relation for receiving an end plate.

As best shown in FIG. 5, a pair of the channel members 14*a* and 14*b* are arranged in a back-to-back spaced relation. An end plate 16 formed of a rectangular piece of metal is provided for each end of the beam, only one, 16*a*, being illustrated in FIG. 5. The terminal edge of each end of the web section 24 of the channel members 14 is foreshortened at 38 about one-half the thickness of an end plate 16. Accordingly, the channel members 14*a* and 14*b* form at their ends a plate-receiving area of a size and shape corresponding to an end plate 16 having the corners thereof defined by the inturned flanges 22*a* and 22*b* of each channel member 14*a* and 14*b*. When inserted in the plate-receiving area, an end plate 16 abuts against the terminal ends 38 of the foreshortened web section 24 with one-half of its thickness extended beyond the leg sections 20 and flanges 22 of the channel members 14 (FIG. 1). The end plates 16 are secured to the channel members 14 by weldments 40 (FIG. 7) over the outwardly exposed edges of end plates 16, constituting extensions of the channel members 14 and smoothly interconnecting the end plates 16 to the channel members 14 thereby forming an integral beam member 10 (FIG. 1). Added strength may be attained by additional weldments 44 between the end plates 16 and the channel members 14 on the inside of the beam member 10.

In assembly into the beam member 10, the channel members 14 are spaced apart by two and one-quarter inches. A block 42 (FIG. 5) is welded to the web section 24 of each of the channel members 14 inside the gap between the channel members 14 at three foot spaced intervals from the end plates 16 and serves to maintain the spacing of the channel members 14 and strengthen the resulting beam 10.

The end plates 16 have a plurality of openings for use in interconnecting the beam members 10 to other elements of the concrete form assembly 12 and for access to the interior of the beam member 10. A central large opening 46 permits access through the end plates 16 to the gap between the spaced-apart channel members 14. Eight bolt openings 48 in the end plates 16 are also provided, four that are located adjacent the corners of the end plate 16 and four located centrally of the sides of the end plate 16.

A plurality of beam members 10 can be arranged end-to-end with adjacent end plates in abutting contact. Nut and bolt assemblies 50 (FIG. 1) are inserted through the openings 48 to releasably interconnect the individual beam members 10*a–c* to form beam assemblies of extended length. The bolt assemblies 50 are also used to releasably interconnect the beam members 10 in a relatively perpendicular relationship, as at 52 in FIG. 1, or to releasably interconnect a beam member 10 to an angle adaptor 54 when used as part of a bracing structure for the form assembly 12.

Figure 7:
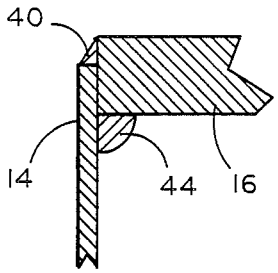
FIG. 7 is an enlarged detail sectional view taken along the line 7—7 of FIG. 2 and showing the connection by weldments of an end plate to a channel member in the present invention.
Figure 6:
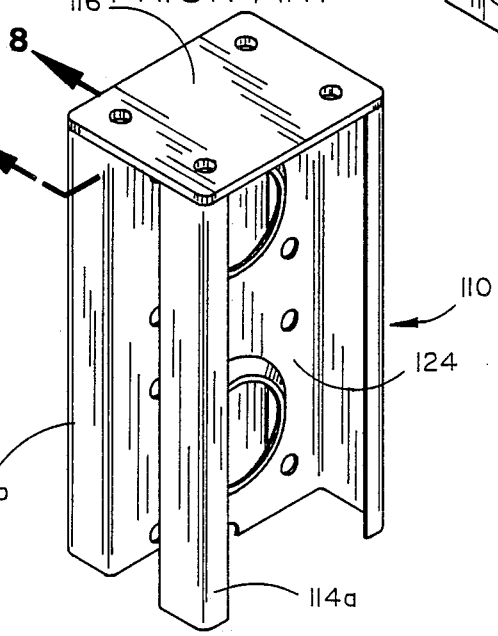
FIG. 6 PRIOR ART
FIG. 6 is a detail perspective view of one end of a conventional beam member formed by a pair of channel members showing the end plate secured in abutting engagement with the terminal straight ends of the channel members.
Figure 8:
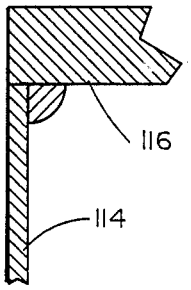
FIG. 8 PRIOR ART
FIG. 8 is an enlarged detail sectional view taken along the line 8—8 of FIG. 6 and showing the connection by weldments of an end plate to a channel member of the prior art beam member.

Conventional beams, as illustrated in FIG. 6 at 110, have spaced apart channel members 114*a* and 114*b* of a transverse cross section substantially identical to the channel members 14. The web sections 124 of the beam members 110 are not foreshortened, however, so that an end plate 116 merely sits atop the terminal ends of the channel members 114 (FIG. 8) rather than residing partially inside the plate-receiving area formed by the pair of spaced apart channel members 14 of the present invention (FIGS. 2, 5 and 7). Accordingly, welding of the end plates 116 to the channel members 114 results in a much lower strength beam member 110 than the beam member 10 of the present invention. The method and design of securing the end plates 16 to the channel members 14 as described above permits a plurality of beam members 10 to be bolted end-to-end as a continuous full strength beam assembly of almost any length. The beam assembly will have the same strength as its individual component beam members 10.

In the preferred embodiment, the channel members 14 are formed of one-eighth inch steel and the bolt openings are spaced on three inch centers and the large openings 28 are spaced on nine inch centers. The four openings 32 are thirteen-sixteenths in diameter and located at the corners of a six inch square centered on a large opening 28. Each end plate 16 is made of one-half inch steel and the web sections 24 of the channel member 14 are foreshortened by about one-quarter inch so that about one-quarter inch of the end plate 16 extends beyond the leg section 20 and flanges 22 of the channel members.

Although the invention has been described with respect to a preferred embodiment thereof, it is to be understood that it is not to be so limited since changes and modifications can be made therein which are within the full intended scope of the invention as defined by the appended claims.

I claim:

1. A method for fabricating a high-strength, lightweight beam from a sheet of metal material, comprising:

(a) forming from the sheet material a channel-shaped member having a pair of transversely opposite leg sections with inturned terminal edges and an interconnecting web section;

(b) providing a rectangular metal end plate for each end of the beam having a thickness greater than the thickness of the sheet material;

(c) foreshortening the terminal ends of said web section of said channel member by an amount substantially equal to about one-half the thickness of an end plate;

(d) positioning a pair of said channel members with the foreshortened web sections thereof in a back-to-back spaced relation to provide a rectangular plate receiving area, of a size and shape of an end plate, having the corners thereof defined by said inturned terminal edges of said leg sections;

(e) locating an end plate within a plate-receiving area against said foreshortened web sections at the terminal ends thereof; and (f) securing each end plate to a channel member by a weldment extended over the surfaces of said end plates exposed outwardly from beyond the leg sections of said channel members.

2. The method as defined in claim 1, wherein said weldment constitutes an extension of said leg sections.

3. The method as defined in claim 1, wherein said securing step includes a weldment extended over the outwardly exposed surfaces of said end plates beyond said leg sections and inturned terminal edges of said leg sections.

4. The method as defined in claim 3, wherein said weldment is of a transverse cross-section to form a smoothly rounded edge interconnecting said end plates and said leg sections.

5. The method as defined in claim 1, wherein said securing step includes a weldment overlying substantially every point of contact between said end plates and said channel members.

6. The method as defined in claim 1, further comprising the step of:

punching a plurality of longitudinally spaced openings in said web section to lighten said channel members.

7. The method as defined in claim 1, further comprising the step of:

forming in said web section a plurality of longitudinally spaced openings each of which has a cupped peripheral edge.

8. The method as defined in claim 1, further comprising the steps of:

inserting in close contact relation between said spaced web sections a plurality of block members longitudinally spaced at a regular interval; and securing said block members to each of said channel members.

9. A beam made following the method of claim 1.

* * * * *